US005351618A

United States Patent [19]

Brent et al.

[11] Patent Number: 5,351,618

[45] Date of Patent: Oct. 4, 1994

[54] SHOCK TUBE INITIATOR

[75] Inventors: Geoffrey F. Brent, Dundonald; Malcolm D. Harding, Irvine, both of Scotland

[73] Assignee: Imperial Chemical Industries PLC, London, United Kingdom

[21] Appl. No.: 937,787

[22] Filed: Sep. 2, 1992

[30] Foreign Application Priority Data

Sep. 9, 1991 [GB] United Kingdom ..... 9119217

[51] Int. Cl.[5] ..... C06C 5/04

[52] U.S. Cl. ..... 102/275.8

[58] Field of Search ..... 102/875.8

[56] References Cited

U.S. PATENT DOCUMENTS

| | | | |
|---|---|---|---|
| 3,032,449 | 5/1962 | Fox et al. | 149/7 |
| 4,220,087 | 9/1980 | Posson | 102/27 R |
| 4,290,366 | 9/1981 | Janoski | 102/202.3 |
| 4,756,250 | 7/1988 | Dias dos Santos | 102/275.1 |
| 4,757,764 | 7/1988 | Thoreson et al. | 102/312 |
| 4,917,017 | 4/1990 | Beltz | 102/470 |
| 5,101,729 | 4/1992 | Noble et al. | 102/275.8 |
| 5,166,470 | 11/1992 | Stewart | 102/275.5 |

FOREIGN PATENT DOCUMENTS

| | | | |
|---|---|---|---|
| 0344098 | 3/1981 | European Pat. Off. . | |
| 477678 | 11/1915 | France . | |
| 2146555 | 3/1973 | France | C06C 7/02 |
| 2441598 | 6/1980 | France | C06C 5/04 |
| 8808414 | 2/1988 | PCT Int'l Appl. . | |
| 2242010 | 1/1972 | United Kingdom . | |

*Primary Examiner*—Peter A. Nelson

*Attorney, Agent, or Firm*—Cushman, Darby & Cushman

[57] ABSTRACT

A shock tube initiator comprises a plastics tubing having an unobstructed axial bore, said tubing having throughout its length an inner surface, and unconsolidated reactive materials provided upon said surface as a loosely adherent dusting of shock-dislodgeable particles at a core loading sufficiently low to avoid rupture of the tubing in use, wherein said reactive materials comprise fuel particles selected from the group consisting of metals, quasi-metals and non-metallic fuels, and, as oxidant, at least about 20% (by weight) of ammonium perchlorate, preferably up to about 99% (by weight) ammonium perchlorate.

14 Claims, 1 Drawing Sheet

Filled points indicate reaction
ca 100mg SAMPLES

Filled points indicate reaction
ca 100mg SAMPLES

SHOCK TUBE INITIATOR

FIELD OF THE INVENTION

This invention concerns improvements in non-electric low-energy fuses, that is to say, transmission devices in the form of elongated plastics tubing having an unobstructed axial bore, and housing reactive or detonable particulate substances at a core loading sufficiently low for there to be no cross-initiation of a similar tube placed alongside (or lateral direct initiation of a surrounding commercial emulsion blasting explosive) when such a device is fired.

BACKGROUND OF THE INVENTION

Ordinarily the core material detonates but in some types rapid deflagration or pyrotechnic reaction suffices as when the tubing is connected to a detonator within which a deflagration to detonation transition occurs. The signal transmission tubing is itself initiated by an electric cap, a non-electric detonator, an electric discharge device or indeed by any other means capable of initiating the required self-sustaining reaction or detonation of the core material. A favoured type of low energy fuse is the so-called shock tube as described in, and cross-referenced in, European Patent No. 327 219 (ICI).

This invention relates particularly to shock tube fuses. For present purposes, a shock tube fuse is one in which an initiation signal for a non-electric signal delay device or detonator (instantaneous or delay) is transmitted through an unobstructed internal bore of an extruded flexible plastics tubing by induced detonation of a contained unconsolidated mixture of particles of reacting substances loosely adherent to the bore surfaces and distributed thereover as a shock-dislodgeable dusting. The plastics material of which the tubing is formed may suitably be as described in the prior art referenced hereinbefore. The internal bore of the tubing is usually narrow; and is usually circular (though it need not be) o Common shock tube fuse dimensions are I.D. 1.3 mm, O.D. 3.0 mm, but the trend is towards smaller bores, less plastics usage, and lower mass per unit length of reaction mixture. For most practical purposes the bore volume per metre of length will be less than $\pi/2\times10^{-6}\,m^3$, and may be less than $\pi/4\times10^{-6}\,m^3$, corresponding to I.Ds. of circular cross-section tubing of about 1.4 and 1.0 mm respectively.

The core loading of reacting substances in shock tube fuses in use today is commonly in the range of from 15 to 30 mg/m of tube length (where the tube has an I.D. of around 1.3 mm) or 8 to 20 mg/m where the tube has a smaller I.D. say under 1 mm. These figures correspond to a loading per square metre of tube inner surface of below 10 g, and to a loading per cubic metre of tube bore volume of about $10\text{–}30\times10^3$ g. These figures for surface area loading and bore volume loading are better guidelines for choosing suitable tube loadings in mg/m of tube than the above quoted mg/m figures where the inner bore of the plastics tube is other than circular in cross-section.

A preferred method of producing a shock tube fuse is to extrude a suitable plastics material capable of forming, on cooling, a permanent chosen tubular form and possessing requisite inner surface affinity for particulate reacting mixture, and simultaneously through the extrusion head introducing the particulate reacting mixture in to the interior of the tube whereupon it becomes loosely adherent, but shock-dislodgeable, on the inner tube bore surface. A presently favoured reacting mixture is a mixture of aluminium and HMX in a 6:94 weight ratio. However, this mixture (as in HMX alone) is quite sensitive to the levels of temperature which need to be developed for rapid extrusion of tube-forming plastics and a graph of "time to reaction" vs sample temperature for these substances quantifies the risk of runaway reaction with all the attendant hazards. The test which enables this graph to be drawn is the Henkin McGill Test, described in the literature. This thermal sensitivity imposes constraints on the tube extrusion technology, on the choice of plastics, and on the rate of tube extrusion having regard to the effectiveness of the cooling system used to bring about tube consolidation at the chosen cross-sectional I.D./O.D.

SUMMARY OF THE INVENTION

The Applicants have found that a most effective alternative to Al/HMX as the reacting mixture is a mixture of ammonium perchlorate (AP) particles and fuel particles. This mixture gives, at the same levels of core charge as described above, and over a range of fuel:AP relative weight proportions a robust detonation that travels along the shock tube fuse at around 1600 m/s and provides a strong initiation impulse to an attached delay element or detonator while being itself initiable by current conventional means and being less prone than Al/HMX mixtures to cause tube bursts when fired. Not only, however, is the performance of the shock tube fuse very satisfactory but the mixture of fuel and AP is, within a wide choice of effective fuels and relative proportions, very stable as shown by the Henkin McGill Test to the temperatures found in molten plastics. This stability allows greater line extrusion speeds to be used when producing shock tube fuse and a greater choice of plastics from which to produce the tubing (or the inner tubing, if a bi-layer tube is being produced by over-extrusion or coating of a second plastics layer on to the first-formed tube). Tubing containing Al/AP as the reactive mixture has also been found to exhibit superior resistance to failure from oil ingress as compared to conventional tubing containing Al/HMX.

Preferred fuels are metals or quasi metals such as Al, Si, B, Fe, W, Mg, Ti, Zn, especially Al and Al/Si mixtures, but carbon, carbonaceous materials and hydrocarbons and mixtures of any of the foregoing, may be used.

Oxygen balance, as between the fuel and the AP is not necessary either for initiation of the fuse, or signal propagation, or detonator initiation. Thus, while AP alone does not function, a mixture of 1 part Al to 99 parts AP by weight will fire. In the case of Ai:AP mixtures (including also those in which Si is added as a third component to bring the mixture to, or closer to, oxygen balance if desired) the preferred range of weight ratios of Al to AP is 8:92 to 40:60. Present experimental results suggest this is a generally optimal range for fuel:AP ratios. For example, an Al/Si/AP mixture of 8:20:72 ratio (parts by weight) is very satisfactory. A mixture of 10 parts by weight carbonaceous pigment and 90 parts by weight of AP also fires. Results achieved to date indicate that at least 20% by weight of AP should be used in the fuel:AP mixture.

In general, no oxidant other than AP is necessary or desirable but the AP may be diluted with potassium perchlorate ($KClO_4$) without sacrificing thermal stability or, if AP is the major part of the AP:KP mixture, prejudicing unduly fuse performance at least at the higher levels of core charge.

A summary of results for various fuel:AP mixtures is given in Table 1 appearing hereinafter.

TABLE 1

Figure 1:
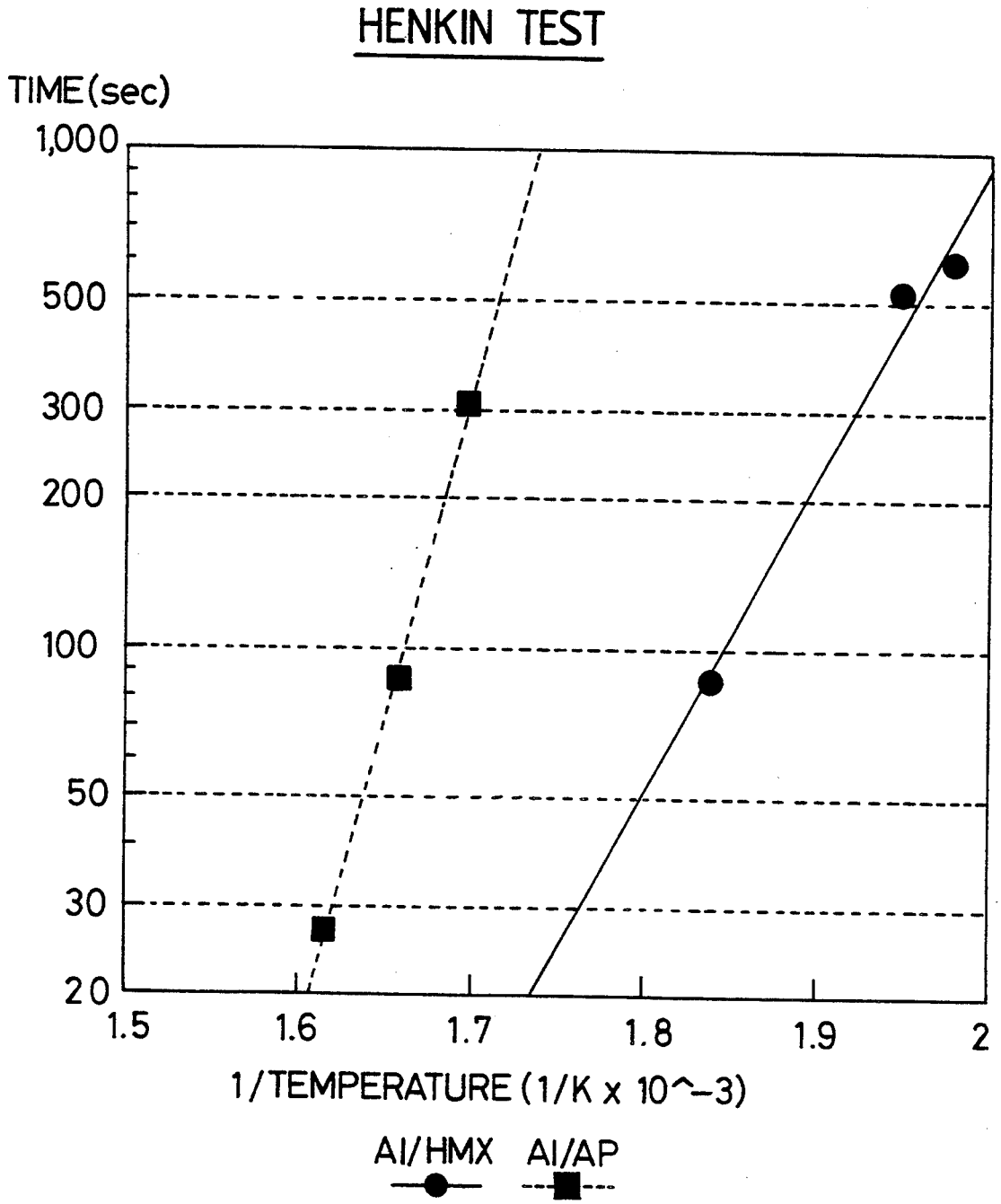
In FIG. 1 attached Henkin Test results for Al/HMX, and Al/AP are displayed. The log time scale is marked in seconds, the inverse of temperature (1/Kelvin$\times 10^{-3}$) scale is marked linearly and the points are reaction events. The substantially enhanced thermal stability of AP over HMX (and other secondary explosives such as HNS, PETN, TNT, RDX) coupled with its gas generant role is the essential basis of this invention. No reference has been found in the shock tube fuse literature that AP may be used as the oxidant in the fuel: oxidant mixture thereof, although references exist to the possible use of metal/KP mixtures (which do not give such a robust initiating signal). The igniter prior art describes the use of Al/AP consolidated mixtures at high core loadings (e.g. 0.6 g/ft) for propellant ignition.

| Tubing was made as follows: | | | Mean Core | Signal |
|---|---|---|---|---|
| % AP by weight) | | % Al (by weight) | Charge mg/m | Velocity mg/m |
| 100 | | 0 | 9 | Fail |
| 99 | | 1 | 40 | 1600 |
| 98 | | 2 | 50 | 1600 |
| 97 | | 3 | 25 | 1550 |
| 95 | | 5 | 19 | 1550 |
| 92 | Optimum | 8 | 20 | 1600 |
| 88 | Range | 12 | 18 | 1650 |
| 60 | | 40 | 5–17 | Fire |
| 40 | | 60 | 5–60 | 990 |
| 20 | | 80 | 5–17 | 850 |
| Other fuels: | | | | |
| Al/Si/AP | | 8/20/72 | 20 | 1500 |
| Carbonaceous pigment/AP | | 10/90 | 15 | Fire |

The tube was made of Surlyn (an ionomer) and had an I.D. of 1.3 mm. "Surlyn" is a Du Pont Trademark. The signals of greater than 1500 m/s velocity would initiate a standard detonator as presently used in shock tube fuse systems.

Tubing has also been made from a polyethylene blend as used for the ICI product EXEL TM on a production plant, as follows:

| % AP | % Al | Core Charge mg/m | Signal velocity m/s |
|---|---|---|---|
| 90 | 10 | 17 | 1770 |

Performance characteristics such as initiability and initiation of detonators were found to be good. The oil resistance of this tubing was higher than that of tubing containing the conventional Al/HMX composition.

The invention also extends to shock tube fuse systems comprising delay elements and/or detonators connected to one or both ends of the shock tube fuse of the invention as aforedescribed.

We claim:

1. In a shock tube initiator tube comprising a plastics tubing having an unobstructed axial bore, said tubing having throughout its length an inner surface, and unconsolidated reactive materials provided upon said surface as a loosely adherent dusting of shock-dislodgeable particles at a core loading sufficiently low to avoid rupture of the tubing in use, wherein said reactive materials comprise fuel particles selected from the group consisting of metals, quasi-metals and non-metallic fuels, the improvement wherein the fuel particles include, as oxidant, at least about 20% (by weight) of ammonium perchlorate.

2. The shock tube initiator claimed in claim 1 wherein the reactive materials comprise up to about 99% (by weight) ammonium perchlorate.

3. The shock tube initiator claimed in claim 2 wherein the amount of ammonium perchlorate lies in the range of from about 40 to about 98% (by weight).

4. The shock tube initiator claimed in claim 3 wherein the amount of ammonium perchlorate lies in the range of from about 60 to about 92% (by weight).

5. The shock tube initiator claimed in claim 4 wherein the fuel is selected from the group consisting of metals and quasi-metals, and is present in an amount of from about 8 to about 40% (by weight).

6. The shock tube initiator claimed in claim 1 wherein the metal or quasi metal fuel is selected from the group consisting of Al, Si, B, Fe, W, Mg, Ti, and Zn.

7. The shock tube initiator claimed in claim 5 wherein the metal fuel is Al.

8. The shock tube initiator claimed in claim 7 wherein the reactive materials comprise about 10 parts (by weight) Al and about 90 parts (by weight) ammonium perchlorate.

9. The shock tube initiator claimed in claim 6 wherein the fuel comprises a mixture of Al and Si.

10. The shock tube initiator claimed in claim 9 wherein the reactive materials comprise a mixture of Al, Si and ammonium perchlorate in a weight ratio of 8:20:72.

11. The shock tube initiator claimed in claim 1 wherein the fuel particles comprise carbon, carbonaceous materials, hydrocarbons and mixtures of any of the foregoing.

12. The shock tube initiator claimed in claim 11 wherein the reactive materials comprise about 10 parts (by weight) carbonaceous material and about 90 parts (by weight) ammonium perchlorate.

13. The shock tube initiator claimed in claim 1 wherein the reactive materials comprise an oxidant mixture of ammonium perchlorate and potassium perchlorate, the former being present as the major component of said oxidant mixture.

14. The shock tube initiator claimed in claim 1 wherein the core loading of reactive materials is no greater than 10 g per square metre.

* * * * *